US005253781A

United States Patent [19]

Van Melle et al.

[11] Patent Number: 5,253,781

[45] Date of Patent: Oct. 19, 1993

[54] DISPOSABLE DRINK-THROUGH CUP LID

[75] Inventors: Hubert Van Melle, Etobicoke; Terrance N. Durdon, Milton, both of Canada

[73] Assignee: James River Corporation of Virginia, Richmond, Va.

[21] Appl. No.: 905,361

[22] Filed: Jun. 29, 1992

[51] Int. Cl.[5] ..... A47G 19/22

[52] U.S. Cl. ..... 220/713; 220/380

[58] Field of Search ..... 220/306, 711, 712, 713, 220/714, 717, 380; 222/566, 570

[56] References Cited

U.S. PATENT DOCUMENTS

| | | | |
|---|---|---|---|
| 2,740,229 | 4/1956 | Wittwer | 220/712 X |
| 3,750,722 | 8/1973 | Nowak | 222/570 X |
| 4,441,624 | 4/1984 | Sokolowski | 220/254 |
| 4,589,569 | 5/1986 | Clements | 220/380 |
| 4,961,510 | 10/1990 | Dvoracek | 220/713 |

*Primary Examiner*—Allan N. Shoap
*Assistant Examiner*—Nova Stucker
*Attorney, Agent, or Firm*—Sixbey, Friedman, Leedom & Ferguson

[57] ABSTRACT

A disposable volume-extending drink-through lid for hot and cold beverages that extends beyond the upper edge of a drinking cup is provided. The lid may be integrally formed by conventional thermoforming processes to include a cup engaging section, a raised volume-extending section and a drink-through section above the upper surface of the volume-extending section to allow a consumer to drink without leakage or spills beverages such as whipped cream-topped cappuccino, ice cream sodas and the like while moving or in a moving vehicle.

14 Claims, 2 Drawing Sheets

DISPOSABLE DRINK-THROUGH CUP LID

TECHNICAL FIELD

The present invention relates generally to disposable cup lids for disposable cups and specifically to a volume-extendable disposable cup lid with an integral drinking spout that is especially suitable for whipped cream-topped or foamy beverages.

BACKGROUND OF THE INVENTION

The advent and growth of fast food restaurants and the increasing popularity of "take-out" food services has greatly increased the need for sealed disposable containers in which food and drink can be carried to the place where they are ultimately consumed. Quite frequently the food and drink are consumed in a moving vehicle or while the consumer is moving. Drinks, particularly hot drinks, can easily spill when they are being consumed under these circumstances and can cause burns and stain clothing or vehicle upholstery. Some types of beverages, such as whipped cream-topped cappuccino, freezes and the like, that are served by fast food or take-out food service establishments include or have added to them ingredients which result in the beverage extending above the upper edge of the cup. Such beverages are difficult to seal against spills. Consequently, lids for disposable drink containers that allow the consumer to drink the beverage inside while the lid remains on the cup have been proposed to solve some of these problems.

U.S. Pat. No. 4,589,569 to Clements, for example, discloses a lid for a drinking cup which is raised sufficiently above the top rim of the cup it is intended to close to permit the formation of a recess in the lid to accommodate the consumer's upper lip and form a spout at one annular edge of the lid. Although this lid will allow the consumer to drink from the cup while moving or in a moving vehicle, the semicircular shape of the spout does not always fit comfortably in the consumer's mouth, and excess liquid beyond that which can be swallowed easily tends to accumulate in the recess and can spill down the consumer's face. The lid disclosed in this patent does not extend the cup volume and therefore will not easily accommodate beverages that extend above the upper edge of the cup. In addition, the dimensional relationships between the top of the drinking spout and the center of the cup lid, which is only slightly recessed below the spout opening will result in the consumer's nose contacting the cup lid, especially while the last of the beverage is being consumed. This can be somewhat annoying and uncomfortable, particularly if the consumer is drinking and driving at the same time.

U.S. Pat. No. 4,333,583 to Montemarano discloses a cup lid with a removably covered spout which is raised above the surface of the cup. While this design may solve some of the spillage problems previously mentioned because the entire spout will fit inside the consumer's mouth, it will not expand the cup volume to effectively accommodate beverages topped with whipped cream or foaming beverages, such as ice cream sodas, that are higher than the top of the cup.

The domed container lid disclosed in U.S. Pat. Nos. Re. 29,989 and 3,952,910 should expand the cup volume to accommodate beverage toppings and foam. However, the drinking opening is awkwardly placed relative to the dome and both likely to be somewhat uncomfortable to use and lead to spills. The drinking cover disclosed in U.S. Pat. No. 4,441,624 to Sokolowski, which will also expand cup volume to accommodate beverage toppings, suffers from additional disadvantages. Spillage from the surface level drinking opening may occur while the consumer is drinking, and there is no provision for drainage of excess liquid back into the cup.

The prior art, therefore, has failed to disclose or suggest a disposable container lid that extends the volume of the cup with an extended volume section above substantially the entire cup surface to accommodate beverage toppings or foamed beverages and a substantially spill-free integral drinking spout that is extended an additional distance beyond the cup surface, which allows the consumer to drink such beverages easily and neatly.

SUMMARY OF THE INVENTION

It is a primary object of the present invention, therefore, to overcome the disadvantages of the prior art and to provide a disposable volume-extending drink-through cup lid shaped to accommodate hot or cold beverages which have had the volume increased by the addition of whipped toppings, foaming or the like with an integral drinking spout positioned above the extended volume surface of the beverage.

It is another object of the present invention to provide a disposable volume-extending drink-through cup lid having a substantial volume of the lid raised above the cup surface with a drink-through structure raised above this substantial volume that may be integrally formed of a single piece of material by conventional thermoforming processes.

It is a further object of the present invention to provide a disposable cup lid which extends the volume of a cup and includes an integral drinking spout and a drain for returning excess beverage to the cup.

It is yet another object of the present invention to provide a disposable drink-through volume-extending cup lid that is substantially leak-free.

It is yet a further object of the present invention to provide a volume-extending drink-through disposable cup lid especially suitable for sealing disposable cups containing hot and cold beverages, such as whipped cream-topped cappuccino, ice cream sodas and the like.

It is still another object of the present invention to provide a stackable volume-extending disposable cup lid which extends the volume of the cup it covers and includes an integral drinking spout extending beyond the extended volume section.

It is a still further object of the present invention to provide a disposable cup lid which extends the volume of the cup it covers and includes an integral drinking spout protruding from the extended volume section shaped to comfortably accommodate the consumer's lips or to receive a drinking straw.

The foregoing objects are satisfied by providing a disposable cup lid having a configuration which includes a cup engaging section, a volume-extending section and a drink-through section. The extended volume section extends upwardly from the cup rim, which is engaged by the cup engaging section, when the lid is in place on a cup to extend the effective volume of the interior of the cup. An integral drinking spout shaped to accommodate comfortably either the consumer's lips or a straw is provided above the extended volume section and extends outwardly from the cup beyond the extended volume section. A recess to catch excess liquid, which preferably includes a drain, and a vent are provided in the top surface of the extended volume section.

Additional objects and advantages will be apparent from the following description, claims and drawings.

DESCRIPTION OF THE PREFERRED EMBODIMENTS

Currently available disposable drinking cup lids cannot be used effectively both to seal the contents in the drinking cup and provide drink-through capability for certain kinds of beverages, particularly hot drinks topped with whipped cream, such as cappuccino and hot chocolate. Certain cold drinks, too, such as ice cream sodas and freezes, are difficult to seal with available drink-through lids. Until the present invention, the most effective way to seal a disposable drink cup containing one of these beverages with a drink-through lid was to put the drink in a larger size cup so there would be sufficient volume to accommodate the drink and topping, ice cream or foam. However, this solution is ineffective from the beverage seller's perspective because of the difficulty of dispensing standard quantities into a larger container. In addition, the larger containers are more costly. The volume-extending drink-through cup lid of the present invention permits the use of the desired cup size and standard amounts and eliminates the need to use larger cups and estimate the amount of beverage placed in the cup.

Figure 1:
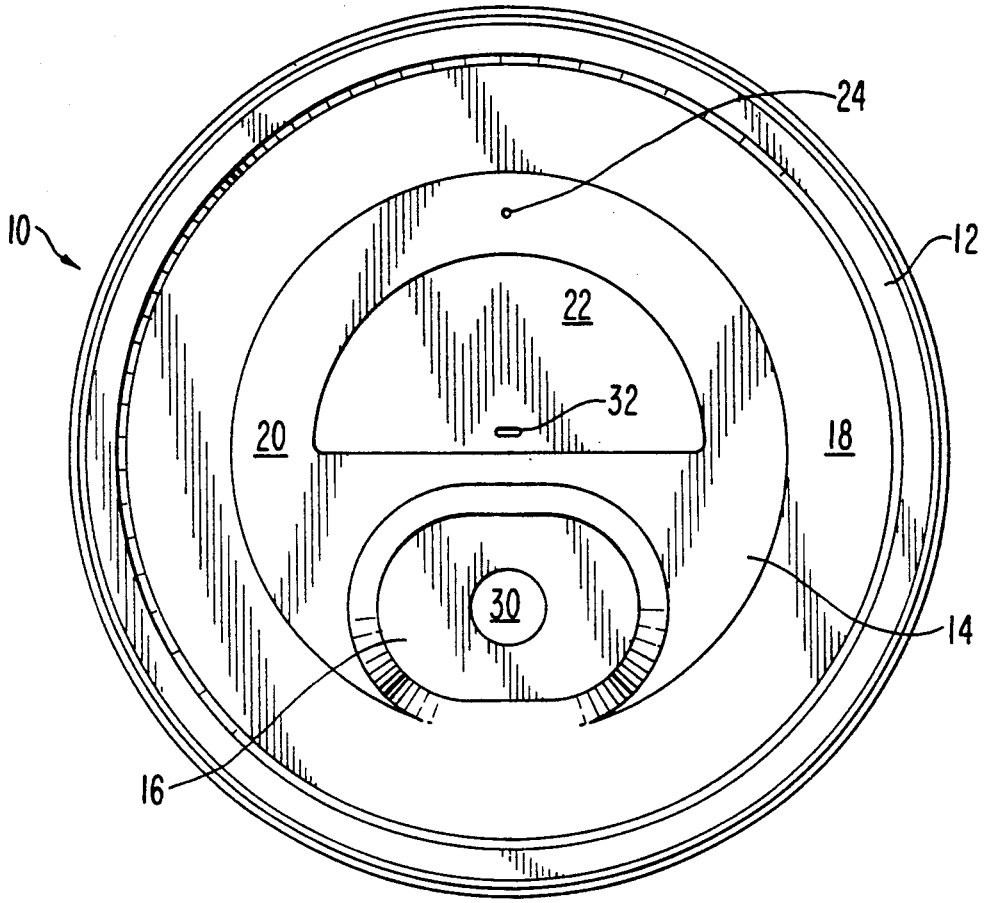
FIG. 1 is a top view of the drinking cup lid of the present invention.

Referring to the drawings, FIG. 1 is a top view of a preferred embodiment of a cup lid 10 according to the present invention. The lid generally includes three main sections; a cup engaging section 12, a volume-extending section 14, and a drink-through or spout section 16. In top view, it can be clearly seen that a peripheral annular surface 18 extends from the cup engaging section 12 to the volume-extending section 14. The volume-extending section 14 has an upper surface 22 from which extends the drink-through section 16. The upper surface 20 of the volume-extending section 14 includes a recess 22 which will catch excess liquid. A vent 24 is preferably positioned in the raised portion of surface 20 adjacent to the recess 22.

Figure 2:
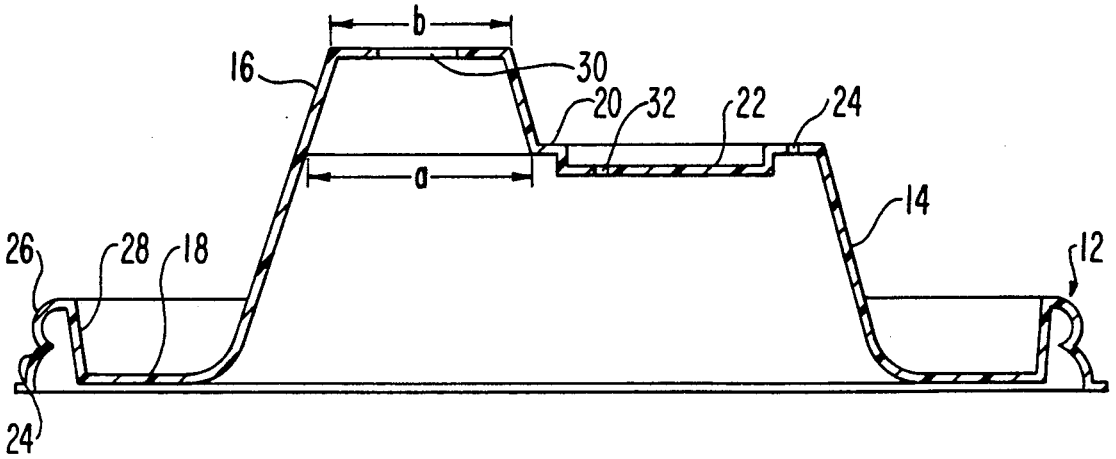
FIG. 2 is a side cross-sectional view of the drinking cup lid of the present invention.

The preferred positional relationship of these structures can be seen in greater detail in FIG. 2, which illustrates the cup lid of the present invention in side view. The cup engaging section 12 is shaped to extend over the top rim of a disposable drink cup and for a distance downwardly toward the cup bottom. The cup engaging section 12 has an exterior skirt section 24 which includes a peripheral groove 26 to sealingly engage the peripheral rim (not shown) on the upper edge of a standard disposable drinking cup. The cup engaging section 12 also has an interior wall section 28 which conforms substantially to the shape of the interior wall of a standard drinking cup. The interior wall section 28 extends to the peripheral annular surface 18. The peripheral annular surface 18 is located at a level relative to the rim of the drink cup where the top surface of a conventional drink cup lid would be. Consequently, in the past, surface 18 would have defined the upper volume limit of the beverage which could be held by the cup.

The cup lid of the present invention substantially expands the volume of the beverage that can be held by a disposable drinking cup. In particular, beverages containing ingredients or having a composition that causes them to extend above the rim of the cup can be effectively dispensed and served in a disposal cup sealed by the lid of the present invention. Although such beverages can be easily served in disposable cups, they are not easily consumed without spills. Exemplary of these beverages are hot beverages such as cappuccino and hot chocolate that have whipped cream on top and such cold beverages as ice cream sodas and freezes. The volume-extending section 14 of the present invention allows the lid to seal the cup without compressing the whipped cream, ice cream, soda bubbles or frozen beverage. In addition, the drink-through section 16, which extends outwardly above the volume-extending section 14 allows the consumer to drink this type of beverage without spills or leakage while the consumer is in a moving vehicle or is moving.

The drink through section 16 includes an opening 30 which enables the drink-through section itself to be used as a drinking straw or to conveniently receive a drinking straw.

The recess 22 in the upper surface 20 of the volume-extending section 14 is provided to catch any excess liquid that may drip down the spout 16 while the consumer is drinking and may include a drain 32 which permits any excess beverage to return to the cup.

Figure 3:
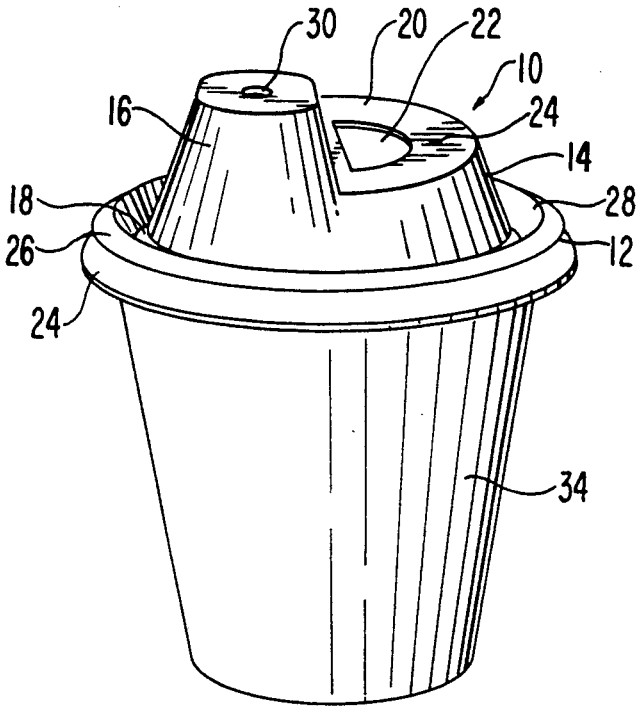
FIG. 3 is a perspective view of a drinking cup showing the lid of the present invention in place on the cup.

FIG. 3 illustrates, in perspective, the volume-extending drink-through lid of the present invention in place to seal a standard drinking cup 34. The volume-extending capability of the present lid can be clearly seen. The distance which the volume-extending section 14 extends above the upper surface of the cup can be varied as desired for different applications. One convenient height for the volume-extending section for a lid suitable for cappuccino and the like is about 0.7 inches. Additionally, the height of the spout or drink-through section 16 can be varied as desired. A convenient height for a cappuccino lid has been found to be about 0.3 inches.

Figure 4:
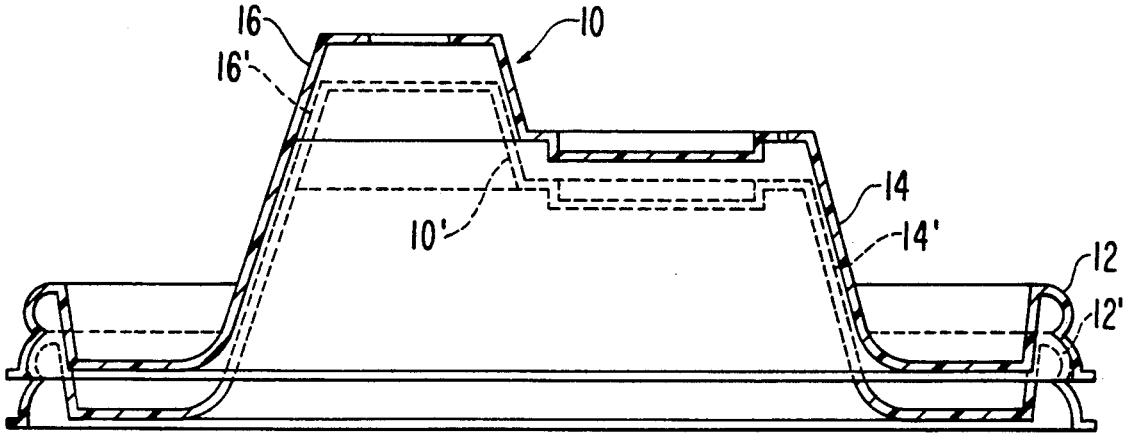
FIG. 4 is a side cross-sectional view of two lids according to the present invention stacked.

FIG. 4 illustrates, in side view, the stacking capability of the drink-through lids of the present invention. This space-saving feature is particularly important because of the large quantities of disposable food service items most fast food restaurants and take-out food services must stock. In FIG. 4 two volume-extending, drink-through lids, 10 and 10' are shown nested together. It can be seen that cup engaging section 12' of lid 10' fits into cup engaging section 12, volume extending section 14' fits into volume extending section 12, and spout 16' fits into spout 16. A large number of lids can be stacked in this manner.

A convenient shape for the volume-extending section 14 and the drink-through section 16 is the frustoconical side cross-sectional configuration illustrated in the drawings. Lids of this shape stack well, as shown in FIG. 4. The frustoconical drink-through section as shown in the drawings with the wider diameter a toward the cup and the smaller diameter b containing the drinking opening is a comfortable configuration for the consumer when the beverage is consumed directly from the cup without a straw. Other cross-sectional configurations could be used as well, however. For example, the volume-extending section 14 could be substantially cylindrical, which would increase the cup volume even more than the frustoconical configuration shown. The spout or drink-through section 16 could also have a cylindrical side cross-sectional configuration. This section could also have a circular, elliptical-or another convenient shape when viewed from the top.

The drink-through opening 30 can be formed in any convenient shape from circular to elliptical to rounded rectangular which can both accommodate a drinking straw and dispense liquid without leakage or spills directly into the consumer's mouth. If desired, the piece of the lid material where the opening will be may be perforated or scored during formation of the lid so that the consumer must remove this piece of material to use the drink-through feature. A separate adhesive-backed flap or the like, which the consumer would remove before drinking, could also be used to cover the opening. Although spills are minimized by the design of the present lid, the provision of some type of covering over the drink-through opening 30 would substantially eliminate them.

The drink-through section 16 is shown located adjacent to and integral with one wall section 34 of the volume-extending section 14. However, the drink-through section could be located elsewhere, such as closer to or in the center of the top surface 20 of the volume-extending section. If this is done, the configuration of the recess 22 and the location of the drain 32 could also be changed as required to accommodate the position of the drink-through section 16.

The volume-extending drink-through lid of the present invention is intended to be disposable and, therefore, is preferably integrally constructed of a single sheet of plastic material suitable for forming such lids. Because the present lid is intended to seal hot beverages, the lid material must be capable of withstanding the typical serving temperatures of hot beverages such as cappuccino, hot chocolate and the like. However, the present lid can also be used for cold beverages and, therefore, can be formed of the types of plastic generally used for cold beverage lids. It is contemplated that the present lids will be formed by thermoforming processes conventionally used for making disposable cup lids.

The cup engaging section 10 of the lid illustrated in the drawings will securely seal available beverage cups with a rounded rim around the upper circumference, such as is typically found in cups constructed primarily of paperboard. Because both hot and cold beverages of the type intended to be covered by the present lid are often served in foam cups that lack this rim, the present lid has been designed to seal this style of cup as well. It is contemplated that the lid of the present invention can be used to seal many difference types of cups.

INDUSTRIAL APPLICABILITY

The present invention will find its primary use in the food service industry, where it can be effectively employed to expand the volume of disposable drink cups holding beverages with ingredients or compositions that cause them to extend beyond the upper edge of the cup. Hot beverages, such as whipped cream-topped cappuccino and hot chocolate, and cold beverages, such as ice cream sodas and freezes, can be sealed against spillage and still allow the consumer to drink the beverage without removing the lid. The volume-extending drink-through lid of the present invention will be especially useful in "take-out" types of food service establishments.

We claim:

1. A disposable cup lid for a drinking cup holding a drinkable beverage comprising:

(a) peripheral cup engaging means for securely engaging an upper peripheral edge of the drinking cup;

(b) volume-extending means formed integrally with said cup engaging means having a substantially frustoconical cross-sectional configuration with a larger diameter end positioned interiorly adjacent to and extending axially relative to said cup engaging means for substantially extending the volume of said cup; and (c) spout means formed integrally with said volume-extending means having a substantially frustoconical side cross-sectional configuration with a wider diameter end located adjacent to said volume-extending means and extending axially therefrom for conducting the beverage from said cup to a consumer, wherein said volume-extending means has an outer surface at a smaller diameter end which includes a recessed area adjacent to said spout means.

2. A disposable cup lid as described in claim 1, wherein said spout means extends from said outer surface adjacent to an outer edge of said outer surface and said recessed area is spaced from said spout means and said outer edge so that said outer surface forms a lip around said recessed area.

3. A disposable cup lid as described in claim 1 wherein said spout means has an elliptical cross-section in plan view.

4. A disposable cup lid as described in claim 2, wherein said lip includes a vent hole and said recessed area includes a drain.

5. A disposable cup lid as described in claim 1, wherein said peripheral cup engaging means includes an interior cup engaging wall, an exterior cup-engaging wall and a cup rim-engaging upper surface.

6. A disposable cup lid as described in claim 5, wherein the larger diameter end of said volume-extending means is spaced inwardly from said interior cup-engaging wall below said cup rim engaging upper surface.

7. A disposable cup lid as described in claim 1, wherein said peripheral cup engaging means, said volume-extending means, and said spout means are integrally formed of a single piece of material.

8. A disposable lid as described in claim 1, wherein said spout means includes an opening sized to receive a drinking straw.

9. A disposable lid as described in claim 1 wherein an outer wall portion of said volume extending means is coextensive with an outer wall portion of said spout means.

10. A disposable drink-through lid for extending the volume of a drinking cup to accommodate beverages with whipped toppings and other components that extend beyond the upper peripheral edge of the cup to seal said cup and prevent spillage of the beverage while permitting a consumer to drink the beverage without removing the lid, said lid comprising a cup engaging section having an upper peripheral edge a frustoconical volume extending section with a larger diameter end adjacent to said cup engaging section and having an upper surface parallel with the upper peripheral edge at a smaller diameter end which extends above the cup engaging section, and a frustoconical spout side cross-sectional section extending axially from the upper surface of said volume extending section and sized to be comfortably received in a consumer's mouth to allow the consumer to drink the beverage.

11. The disposable drink-through lid described in claim 10, wherein said spout section is positioned adjacent to a periphery of the upper surface of the volume-extending section.

12. The disposable drink-through lid described in claim 11, further including a vent located in said upper surface of the volume extending section.

13. The disposable drink-through lid described in claim 12, wherein said lid is integrally formed of a single piece of material.

14. A disposable drink-through lid for sealingly engaging the upper edge of a beverage cup, comprising (a) an exterior peripheral skirt integrally connected to an interior wall to form an annular groove for engaging the cup upper edge;

(b) an annular peripheral surface integrally connected to said interior wall and to a first raised portion having a substantially frustoconical configuration with a larger diameter end adjacent to said peripheral surface and a smaller diameter end defining an outer surface of said first raised portion, said first raised portion for providing a substantially increased contained volume for the cup contents when the lid engages the cup; and (c) a second raised portion having a frustoconical side cross-sectional configuration formed integrally with and above said first raised portion with a diameter end adjacent to said first raised portion outer surface, said second raised portion including drink-through means to permit drinking of a beverage when the lid sealingly engages the cup.

* * * * *